US006151945A

United States Patent [19]

Yoshimura et al.

[11] Patent Number: 6,151,945

[45] Date of Patent: Nov. 28, 2000

[54] CLUSTER TYPE ROLLING MILL AND ROLLING METHOD

[75] Inventors: Yasutsugu Yoshimura, Hitachi; Toshiyuki Yoshimura, Tokyo; Yoshio Takakura; Yujirou Kobayashi, both of Hitachi; Hidekazu Tabata, Takahagi, all of Japan

[73] Assignee: Hitachi, Ltd., Tokyo, Japan

[21] Appl. No.: 09/280,819

[22] Filed: Mar. 30, 1999

[30] Foreign Application Priority Data

Mar. 30, 1998 [JP] Japan ..... 10-83836

[51] Int. Cl.[7] ..... B21B 13/14; B21B 31/07; B21B 31/18

[52] U.S. Cl. ..... 72/241.8; 72/247

[58] Field of Search ..... 72/241.8, 241.6, 72/241.2, 241.4, 242.4, 242.2, 242.6, 247

[56] References Cited

U.S. PATENT DOCUMENTS 2,368,030 1/1945 Larsson ..... 72/242.4

4,703,641 11/1987 Yarita et al. ..... 72/247

FOREIGN PATENT DOCUMENTS 57-202908 12/1982 Japan ..... 72/241.8

63-260614 10/1988 Japan ..... 72/241.8

4-127901 4/1992 Japan .

5-50109 3/1993 Japan .

OTHER PUBLICATIONS

The Hitachi Hyoron, vol. 78, No. 6, pp. 17–20 (1996.6), English version (Hitachi Review vol. 45 (1996), No. 6.

*Primary Examiner*—Rodney A. Butler

*Attorney, Agent, or Firm*—Evenson, McKeown, Edwards & Lenahan, P.L.L.C.

[57] ABSTRACT

A cluster type rolling mill comprises a pair of work rolls, intermediate rolls, backing rolls, backing roll chock movable in the up and down directions, intermediate roll chocks held by the backing roll chocks work roll chocks held by the intermediate roll chocks hydraulic cylinders for shifting the intermediate rolls in the axial direction and hydraulic cylinders for applying bending force to the intermediate rolls and work rolls.

28 Claims, 9 Drawing Sheets

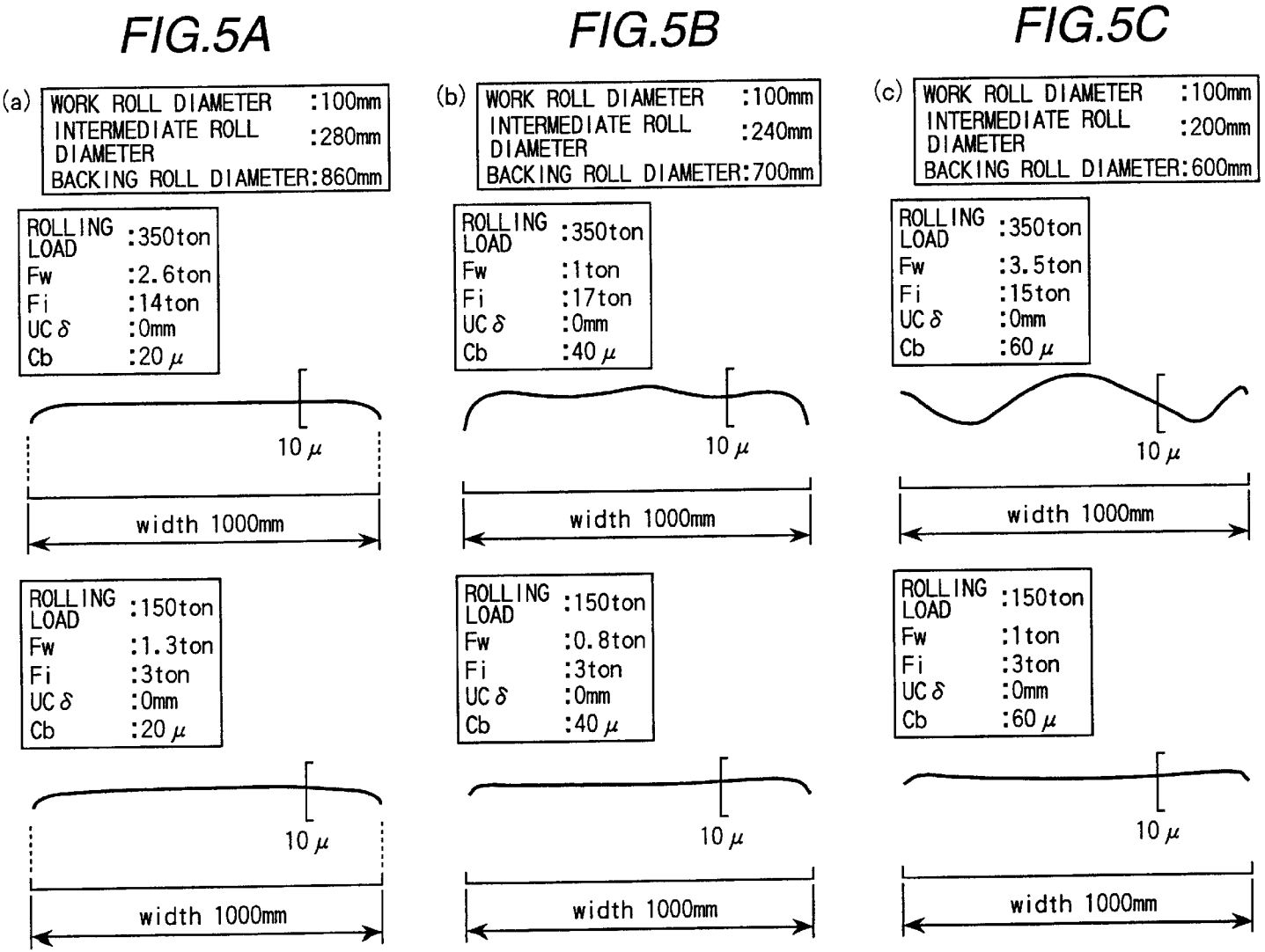
FIG.5A
(a)
WORK ROLL DIAMETER :100mm
INTERMEDIATE ROLL DIAMETER :280mm
BACKING ROLL DIAMETER:860mm
ROLLING LOAD :350ton
Fw :2.6ton
Fi :14ton
UC δ :0mm
Cb :20 μ
10 μ
width 1000mm
ROLLING LOAD :150ton
Fw :1.3ton
Fi :3ton
UC δ :0mm
Cb :20 μ
10 μ
width 1000mm
FIG.5B
(b)
WORK ROLL DIAMETER :100mm
INTERMEDIATE ROLL DIAMETER :240mm
BACKING ROLL DIAMETER:700mm
ROLLING LOAD :350ton
Fw :1ton
Fi :17ton
UC δ :0mm
Cb :40 μ
10 μ
width 1000mm
ROLLING LOAD :150ton
Fw :0.8ton
Fi :3ton
UC δ :0mm
Cb :40 μ
10 μ
width 1000mm
FIG.5C
(c)
WORK ROLL DIAMETER :100mm
INTERMEDIATE ROLL DIAMETER :200mm
BACKING ROLL DIAMETER:600mm
ROLLING LOAD :350ton
Fw :3.5ton
Fi :15ton
UC δ :0mm
Cb :60 μ
10 μ
width 1000mm
ROLLING LOAD :150ton
Fw :1ton
Fi :3ton
UC δ :0mm
Cb :60 μ
10 μ
width 1000mm

CLUSTER TYPE ROLLING MILL AND ROLLING METHOD

BACKGROUND OF THE INVENTION

The present invention relates to a rolling mill with small diameter work rolls and, more particularly, to a cluster type rolling mill and a rolling method using the rolling mill.

Rolling mills provided with small diameter work rolls for the purpose of stably rolling a thin plate of hard material which is difficult to roll and a that requires high surface quality, are known for example, 20-stage Sendzimir mills, 10-stage cluster mills and 6-high rolling mills. Those types of rolling mills will be explained below.

(1) 20-stage Sendzimir Mill

The 20-stage Sendzimir mill is an original type of cluster mill which employs small diameter work rolls. The Sendzimir mill is disclosed in JP A 4-127901, for example.

The Sendzimir mill has, upper and lower work rolls each supported by nine rolls in total composed of two first intermediate rolls, three second intermediate rolls and four backing rolls. The first intermediate rolls each are tapering in shape at an axial end portion and each is shiftable in an axial direction by an axial shifting mechanism. The backing rolls each are divided into a plurality of roll sections in the axial direction (in the plate width direction) and a bearing position of each roll section is adjustable in the pass direction (which is a so-called AS-U backing roll mechanism).

Since the work rolls are small in diameter, the strength is insufficient for transmitting necessary rolling torque through twisting of the work roll. The torque necessary for rolling is transmitted, as tangential force, from the intermediate rolls as driving rolls to the work rolls. In each work roll, horizontal deflection is caused by the tangential force and a rolling load, which becomes the cause of defective shape of a rolling plate.

Therefore, in the rolling mill, the deflection is suppressed to effect excellent shape control by three means of mainly 1) axial shift of the first intermediate roll, 2)crown control of the backing rolls by the AS-U backing roll mechanism, and 3) cluster type support of each work roll by two intermediate rolls.

(2) 10-stage Cluster Type Rolling Mill

An example of a conventional 10-stage cluster type rolling mill is disclosed in JP A 58-50105, for example.

This rolling mill has upper and lower work rolls each supported by four rolls in total composed of two intermediate rolls and two backing rolls. The two backing rolls each are divided into a plurality of roll sections in the axial direction (in the plate thickness direction) as in the 20-stage Sendzimir rolling mill (1), and provided with an AS-U backing roll mechanism. Further, the backing rolls, the intermediate rolls and the work rolls each are supported by chocks, each of which is movable in the housing in the up and down directions. The chocks for the intermediate rolls and work rolls of those chocks are provided with actuators for imparting bending force.

In this types of rolling mill, deflection of the work rolls as mentioned above is suppressed to effect excellent shape control by three means of mainly 1) bending of the work rolls and the intermediate rolls, 2)crown control of the backing rolls by the AS-U backing roll mechanism, and 3) cluster type support of each work roll by the two intermediate rolls.

(3) 6-high Rolling Mill

An example of a conventional 6-high rolling mills is disclosed in JP A 5-50109 and the The Hitachi Hyoron vol.78 No.6 pages 17–20 (1996.6), for example.

The 6-high rolling mill has upper and lower work rolls each supported by two rolls composed of only one intermediate roll and one backing roll. The backing roll, intermediate roll and work roll each are supported by chocks each of which is movable in the housing in the up and down directions as in the rolling mills (1) and (2), and actuators are provided for applying horizontal force on the chocks provided at the roll ends of the work roll.

Further, differing from the above-mentioned rolling mills (1) and (2), the backing roll is not axially divided but a one piece roll, and the work roll is able to be offset to the intermediate roll by moving a support roll supporting the work roll in the pass direction. Further, although not disclosed particularly in the above-mentioned prior art, a construction, other than this construction, in which an intermediate roll having a tapering shape in the axial end portion is made shiftable in the axial direction as in the above-mentioned rolling mill (1), has been already proposed.

In this rolling mill, as for the above-mentioned work roll horizontal deflection, the horizontal deflection of the work roll is suppressed to be small by balancing the offset component of a rolling load caused by offsetting the work roll from the intermediate roll with the roll driving tangential force, and cancelling at the same time the horizontal deflection due to horizontal bending of the work roll and the horizontal deflection due to the tangential force from the intermediate roll and a variation component of the rolling material tension.

However, the above-mentioned prior art still have the following problems.

First since the 20-stage Sendzimir rolling mill has a construction such that all the rolls are covered with the upper and lower housings, it is impossible to provide a mechanism for imparting bending force to the work rolls and the intermediate rolls. Therefore, it is difficult to obtain products such as fine steel materials which are thin and wide and required of high shape precision. Further, because of such a construction, a large gap can not be made between the upper and lower work rolls, so that the facility of passing of a plate is bad and it is impossible to directly detect the rolling load. Further, since the rolling load can not be directly detected, thickness control becomes complicated. Further, marks of the backing roll sections formed by division of a roll in the axial direction are finally transferred to and left on the plate surface through the third intermediate rolls and the second intermediate rolls, so that there is left the problem that the surface quality is lost.

On the other hand, the 10-stage cluster type rolling mill can impart bending force to the work rolls and the intermediate rolls, so that it is possible to easily satisfy the severe requirement of shape precision. Since the backing rolls, intermediate rolls and work rolls are supported by the chocks which are movable in the housing in the up and down directions, it is possible to secure a roll gap at the time of plate passage and to directly detect the rolling load.

However, there is still a the problem that the surface quality becomes bad due to marks of the divided roll sections left on the surface as well as in the above-mentioned 20-stage Sendzimir rolling mill. In particular, in the case of this 10-stage cluster rolling mill, the second intermediate rolls as used in the Sendzimir rolling mill are omitted in order to raise a shape control effect by the division type backing rolls. In such a construction, only one intermediate roll between the work roll and each backing bearing exists, so that marks of the divided backing roll sections are easier to be transferred than in the 20-stage Sendzimir rolling mill and the rolling mill is difficult to be applied for rolling materials required of high surface quality.

In the 6-high rolling mill, the backing roll is a one-piece roll, so marks are not transferred onto the plate and the surface quality of products is not lost, differing from the case of the division type backing rolls. Further, it is possible to easily satisfy the severe requirement of the surface quality by variable offset control and horizontal bending of the work rolls. Further, since the backing rolls, intermediate rolls and work rolls are supported by the chocks which are able to move in the housing in the up and down directions, it is possible to secure a roll gap at the time of passage of a plate and to directly detect a rolling load.

However, although the variable offset control and horizontal bending control bring out their excellent performance in the case where a rolling torque is small relative to a rolling load and in the case of one-way rolling, there is left the problem that control pattern at operation becomes very complicated and the productivity decreases in the case where contact force direction changes reversely each pass of the rolling material as in a reversing rolling mill and in the case where the rolling torque changes largely compared with the rolling load.

An object of the present invention is to provide a cluster type rolling mill and rolling method which can execute excellent shape control by controlling deflection of the work rolls without worsening the surface quality of plate materials, prevent the production efficiency from lowering even if the rolling torque largely changes, and secure good plate passage facility and directly detect a rolling load.

SUMMARY OF THE INVENTION

In order to attain the above object, in a cluster type rolling mill having a pair of work rolls on upper and lower sides of a material traveling path, two pairs of intermediate rolls on the upper and lower sides, contacting the work roll and imparting driving force to the work rolls, and two pairs of backing rolls on the upper and.lower sides, contacting and supporting the intermediate rolls, the present invention provides a pair of backing roll chocks on the upper and lower sides, which pair of backing roll chocks support two upper backing rolls on the upper side of the two pairs of backing rolls and two lower backing rolls on the lower side of the two pairs of backing rolls, respectively; a pair of intermediate roll chocks on the upper and lower sides, which pair of intermediate roll chocks support two upper intermediate rolls on the upper side of the two pairs of intermediate rolls and two lower intermediate rolls on the lower side of the two pairs of intermediate rolls, respectively; a pair of work roll chocks on the upper and lower sides, which pair of work rolls support an upper work roll on the upper side of the pair of work rolls and a lower work roll on the lower side of the pair of work rolls, respectively; a driving means for driving and axially shifting at least the intermediate rolls selected from the intermediate rolls and the intermediate roll chocks; and intermediate roll bending means and work roll bending means for applying bending force to the intermediate rolls and the work rolls, respectively.

The two pairs of intermediate rolls on the upper and lower sides and the two pairs of backing rolls on the upper and lower sides support, in cluster type, the pair of work rolls on the upper and lower sides, whereby it is possible to support a rolling load at an angle of 40–55° to a perpendicular line passing the axes of the work rolls at each of entry and exit sides, for example.

Thereby, it is possible to suppress horizontal deflection of the work rolls due to components of driving tangential force acting in the horizontal direction and to stably cope with a large change in driving torque. At this time, it is possible to further suppress the deflection of the work rolls by optimizing a load distribution by imparting a desired profile to the intermediate rolls through shifting at least the intermediate rolls by the driving means. Further, at this time, by applying bending force to the intermediate rolls and the work rolls by the intermediate roll bending means and the work roll bending means in addition to the above-mentioned intermediate rolls shifting operation, it is possible to further sufficiently suppress the deflection of the work rolls and to effect good shape control.

Further, it is possible to sufficiently suppress the deflection of the work rolls without using a AS-U mechanism, so that the intermediate rolls and the backing rolls each can be a roll of one-piece.

Further, by providing the two pairs of backing rolls on the upper and lower sides, loads to the backing rolls are dispersed to the entry side and exit side. However, by supporting the two upper backing rolls by the upper backing roll chock and supporting the two lower backing rolls by the lower backing roll chock, it is possible to receive the horizontal force loaded on the backing rolls through the intermediate rolls as inner force of the upper and lower backing roll chocks and to support the perpendicular force by the housing as in the conventional 6-high rolling mill.

Further, the work roll chocks are supported by the intermediate roll chocks and the intermediate roll chocks are supported by the backing rolls, however, since the backing roll chocks are movable in the housing in the up and down directions, the work rolls, intermediate rolls and backing rolls are integratedly movable on each of the upper and lower sides in the housing in the up and down directions. Therefore, since it is possible to separate those rolls into rolls on the upper side and rolls on the lower side in the housing to provide a wide space at the time of passing plates, a good plate passing facility can be secured. Further, it is possible to give a large flexibility to the vertical direction to change in roll diameter. Further, it is possible to provide a detecting means at an upper portion of the upper backing roll chock or at a lower portion of the lower backing roll chock, so that a rolling load can be directly detected.

Further, when the roll diameters of the intermediate rolls each are set 220 mm or less and the roll diameter of each of the backing rolls is set 650 mm, a good plate shape can be attained at relatively low load operation, however, complex elongation occurs to worsen the plate shape at relatively high load operation. Therefore, the roll diameter of each of the intermediate rolls is set 220 mm or more and the roll diameter of each of the backing rolls is set 650 mm or more, whereby intermediate roll shifting by the driving means and bending by the intermediate roll and work roll bending means are effectively applied, good shape control can be secured and deflection of the work rolls can be surely suppressed.

Further, when the roll diameters of the intermediate rolls each are made 320 mm or more and the roll diameters of the backing rolls each are made 900 mm or more, a space between the rolls becomes narrow and a cluster type arrangement of the rolls becomes difficult. Therefore, the roll diameters of the intermediate rolls each are set 320 mm or more and the roll diameters of the backing rolls each are set 900 mm or more, whereby occurrence of the structural problems as mentioned above can be prevented.

Further, at this time, when driving tangential force is applied from the intermediate rolls to the work rolls, the intermediate rolls receive the reaction force corresponding to the tangential force at the same time. Therefore, when the roll diameters of the intermediate rolls are too fine, the intermediate rolls are horizontally bent by the tangential force and at least 3 backing rolls are necessary to support the fine intermediate rolls, and geometrical restriction to the roll diameters becomes severe for roll arrangement. The intermediate roll diameter of 220 mm or more can suppress small the horizontal deflection of the intermediate rolls caused by the reaction to the driving tangential force by their rigidity to bending even if the intermediate rolls are supported by two backing rolls.

Further, when the plate width becomes largely wide, in some cases, the shape at central portion of the plate can not be sufficiently controlled by only functions of shifting the intermediate rolls and bending the work rolls and intermediate rolls as mentioned above. In such cases, by making profiles of the backing rolls so that roll curves are in a compensation relation with each other, movement of them by the driving means in a roll axial direction opposite to each other enables good adjustment of the plate shape in the central portion by geometrical action of the profile.

Further, by mounting, on a first common roll shaft, each divided barrel portion eccentrically passed through by the first common roll shaft under the condition that each divided barrel portion is rotated by a desired angle, it is possible to adjust a quantity of a radial projection of each of the divided barrel portions from the first roll shaft.

Thereby, it is possible to sufficiently control the shape at the central portion of a plate even when the width of the plate is largely wide, by adjusting the profile of the first sleeve to a desired profile.

Further, preferably, at least one of the above-mentioned backing rolls has a second roll shaft and a second sleeve mounted on the outer periphery of the second roll shaft and contacting with the corresponding above-mentioned intermediate rolls, and the second sleeve is provided with a pressurized oil path inside the sleeve and constructed so as to be able to adjust the outer diameter profile with the pressurized oil led thereto. For example, it is possible to sufficiently control the shape at the central portion of a plate even when the width of the plate are widened largely, by adjusting the outer diameter surface to a convex shape, for example.

Further, preferably, at least one of the backing roll chocks or the intermediate roll chocks comprises two second bearings rotatably supporting the corresponding two backing rolls or intermediate rolls, two through holes provided corresponding to the positions of the backing rolls or intermediate rolls and two third sleeves rotatably mounted in the through holes and eccentrically arranging the second bearings, wherein the positions of the corresponding rolls in the pass line direction and the height in the up and down directions can be adjusted by rotating each sleeve by a predetermined angle. Further, for example, in the corresponding roll chocks, by rotating two sleeves on the entry side and exit side in opposite directions to each other, a distance between the corresponding two backing rolls or intermediate rolls can be adjusted so that a contact angle between the backing roll and the intermediate roll does not change so much even when roll diameters change.

Further, for example, by using in combination spherical seats and rotating respective sleeves in the corresponding two roll chocks on the operation side and diving side in the opposite directions to each other, it is possible to incline the backing rolls to the intermediate rolls at certain inclination angles. Thereby, it is also possible to adjust apparent crown of the backing rolls.

In order to attain the above object, according to the present invention, in a rolling method of a cluster type rolling mill having a pair of work rolls on the upper and lower sides, two pairs of intermediate rolls on the upper and lower sides, contacting the work rolls, respectively to impart driving force to them and two pairs of backing rolls on the upper and lower sides, contacting the intermediate rolls to support them, a strip is rolled while shifting the intermediate rolls in the axial direction and applying bending force to the intermediate rolls and work rolls.

BRIEF DESCRIPTION OF THE DRAWINGS

FIGS. 5A to 5C each are diagrams of strip shapes obtained by numeral analysis of strip shapes, changing roll diameter and deformation resistance of the strip;

DETAILED DESCRIPTION OF THE PREFERRED EMBODIMENTS

Figure 1:
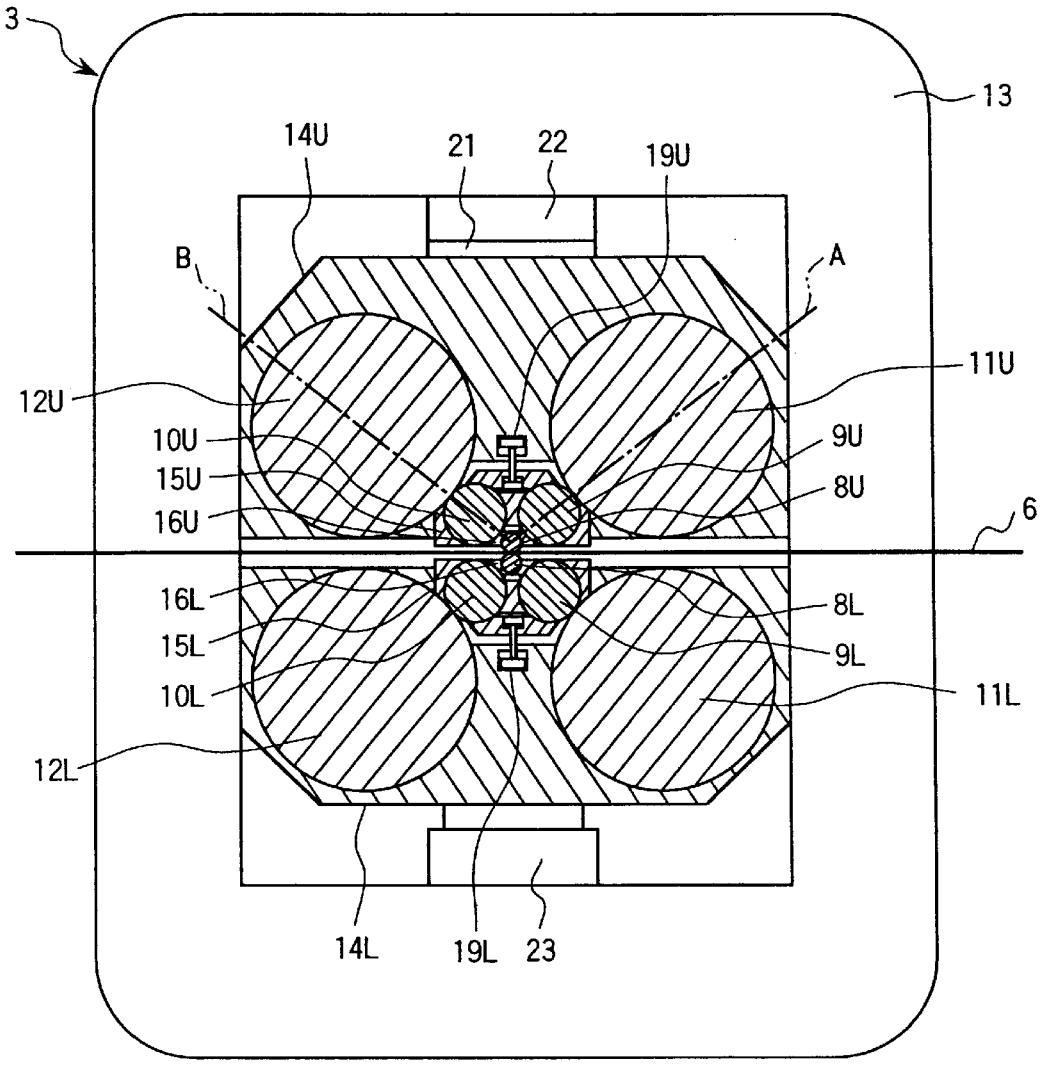
FIG. 1 is a sectional view of a cluster type rolling mill of an embodiment of the present invention.

An embodiment of the present invention will be described hereunder, referring to the drawings.

Figure 2:
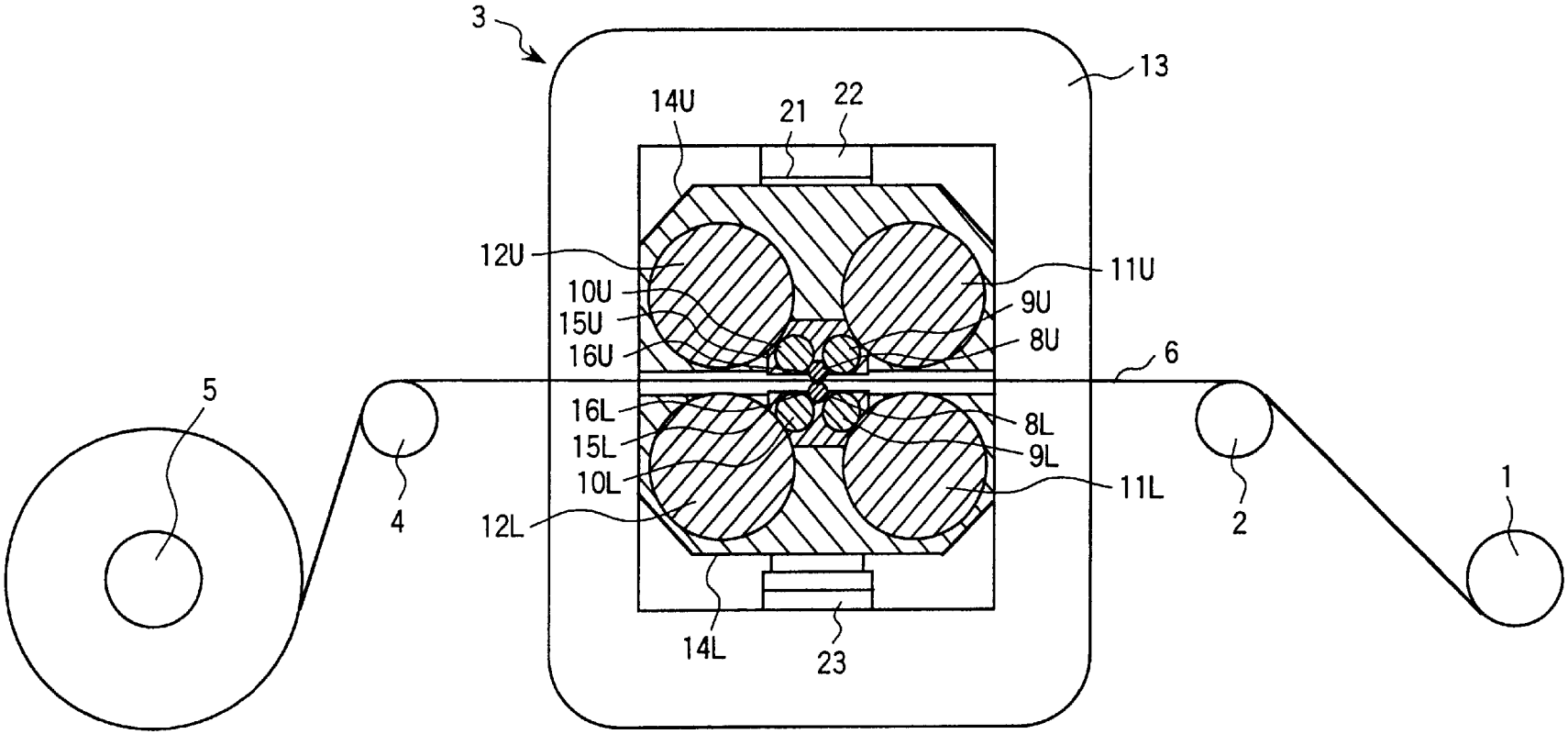
FIG. 2 is a schematic diagram of an arrangement of a rolling equipment provided with the cluster type rolling mill shown in FIG. 1.

An arrangement of the whole construction in outline of a rolling equipment provided with a cluster type rolling mill of an embodiment of the present invention is shown in FIG. 2. In FIG. 2, the rolling equipment has an entry side tension reel 1, an entry side deflector roller 2, the cluster type rolling mill 3, an exit side deflector roller 4 and an exit side tension reel 5, each arranged in turn.

The cluster type rolling mill 3 reversibly rolls a strip 6 which is a rolling material. The tension reels 1 and 5 reversibly wind up and wind off the strip 6 alternately while imparting tension to the strip during rolling. A cross sectional view of the cluster rolling mill 3 of the present embodiment is shown in FIG. 1 showing detailed construction, and the side view thereof is shown in FIG. 3.

Figure 3:
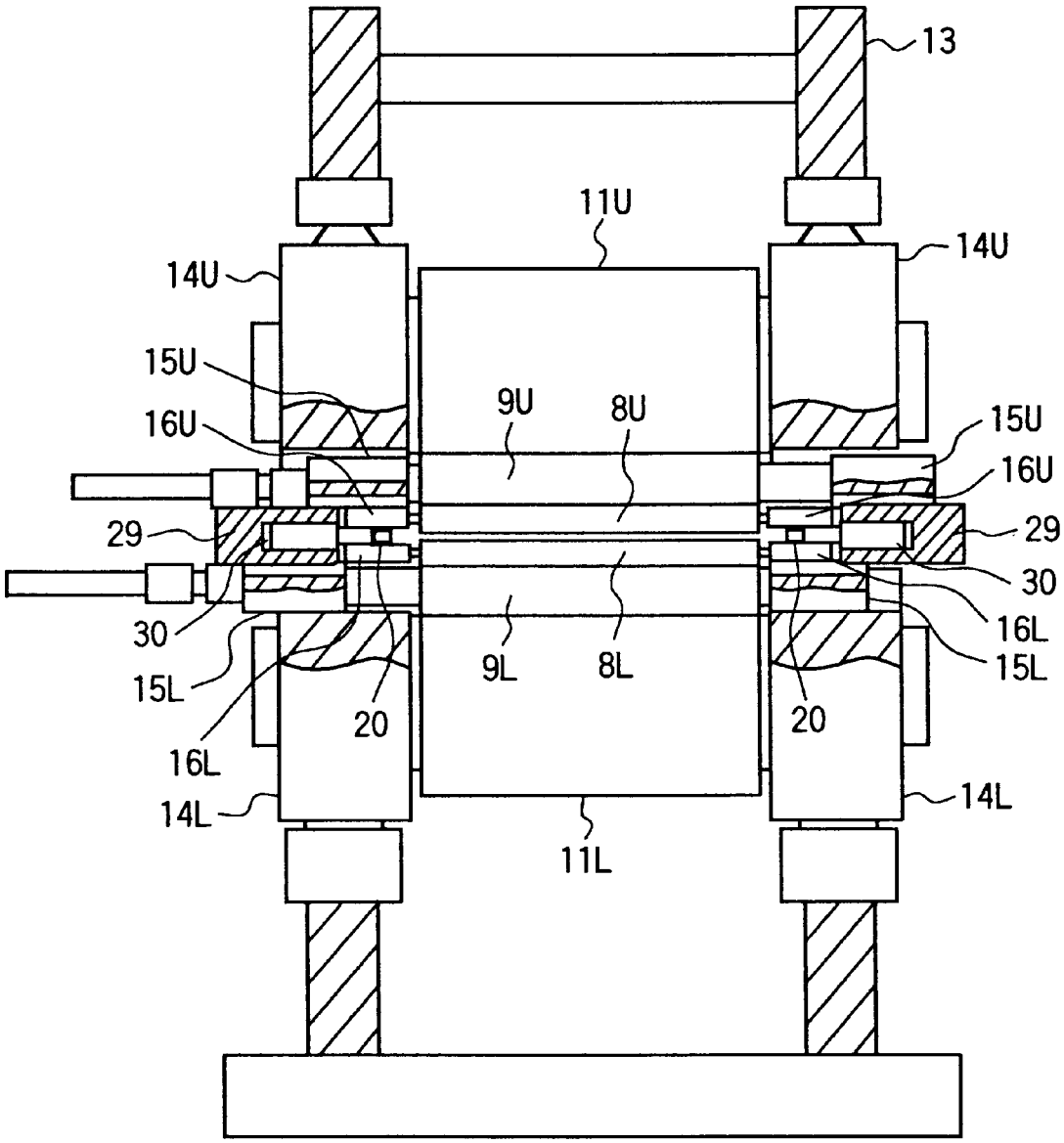
FIG. 3 is a side view of the cluster type rolling mill shown in FIG. 1.

In FIGS. 1 and 3, the cluster type rolling mill is to roll a strip 6 of width 800 mm or more (for example, 1000 mm)

with a rolling load in a range of about 150 ton to 300 ton. Briefly stated, the rolling mill 3 comprises a pair of work rolls 8U, 8L on the upper and lower sides of a strip travelling path. Two pairs of intermediate rolls 9U, 9L and 10U, 10L on the upper and lower sides, which contact with the work rolls 8U, 8L to impart driving force to the work rolls 8U, 8L. Two pair of backing rolls 11U, 11L and 12U, 12L on upper and lower sides, which contact to support the intermediate rolls 9U, 9L and 10U, 10L. A pair of backing roll chocks 14U, 14L (they are provided on both sides, an operation side and driving side, however, they are not given by different symbols as long as different symbols are unnecessary, symbols are given the following other chocks and actuators in the same manner) support the two upper backing rolls and two lower backing rolls of the two pairs of backing rolls on upper and lower sides and are movable in a housing 13 in the up and down directions. A pair of intermediate roll chocks 15U, 15L on the upper and lower sides, support roll end portions of two upper intermediate rolls 9U, 10U and two lower intermediate rolls 9L, 10L of the two pairs of intermediate rolls 9U, 9L and 10U, 10L and are supported by the backing roll chocks 14U, 14L, a pair of work roll chocks 16U, 16L on the upper and lower chocks, which support roll end portions of the upper work roll 8U and lower work roll 8L of the pair of work rolls 8U, 8L on the upper and lower sides, respectively, and are held by the intermediate roll chocks 15U, 15L, respectively. Hydraulic cylinders 18U, 18L (refer to FIG. 4 which is explained later) are used as a driving means for driving and shifting the intermediate rolls 9U, 9L, 10U, 10L and the intermediate roll chocks 15U, 15L hydraulic cylinders 19U, 19L are used as an intermediate roll bending means for applying bending force to the intermediate roll 9U, 9L and a hydraulic cylinder 20 is used as a work roll bending means for applying bending force to the work rolls.

The diameters of the work roll 8U, 8L, intermediate roll 9U, 9L, 10U, 10L and backing roll 11U, 11L, 12U, 12L are 100 mm, 280 mm, 860 mm, respectively. Each of the intermediate rolls 9U, 9L, 10U, 10L and the backing rolls 11U, 11L, 12U, 12L is not divided in the axial direction but it is made as a roll of one piece.

Further, at this time, the axis of the upper backing roll 11U is positioned about on a plane passing the axes of the work roll 8U and the upper intermediate roll 9U as shown by one dotted line A in FIG. 1. The axis of the upper backing roll 12U is positioned about on a plane passing the axes of the work roll 8U and the upper intermediate roll 1OU 10 as shown by one dotted line B in FIG. 1. The lower backing rolls 11L, 12L also have a similar arrangement to the above.

The upper and lower backing roll chocks 14U, 14L are provided with self-aligning roller bearings or tapered roller bearings, and roll neck portions of the upper and lower backing rolls 11U, 11L, 12U, 12L are supported through those bearings. On the upper portion of the upper backing roll chock 14U, a pass line adjusting apparatus 22 is provided through the load cell 21. Further, on the lower portion of the lower backing roll chock 14L, a screw-down device 23 with hydraulic cylinders, for example, is provided, and the lower backing roll is moved upward and downward, whereby a gap between the work rolls 8U, 8L is adjusted to control the thickness of the strip. The rolling mill is constructed so as to provide a large gap between the work rolls 8U, 8L by lowering the position of the lower backing roll 14L by the screw-down device 23 to facilitate a strip passing operation.

The upper and lower intermediate roll chocks 15U, 15L are held by the upper and lower backing roll chocks 14U, 14L, respectively, so as to be embraced thereby. The hydraulic cylinders 19U, 19L are accommodated within the intermediate roll chocks 15U, 15L and the cylinder rod portions of them are engaged with the backing roll chocks 14U, 14L as shown in FIG. 1. Thereby, expansion and contraction of the cylinder 19U, 19L apply bending force to the intermediate rolls 9U, 9L, 10U, 10L through the intermediate roll chocks 15U, 15L.

Figure 4:
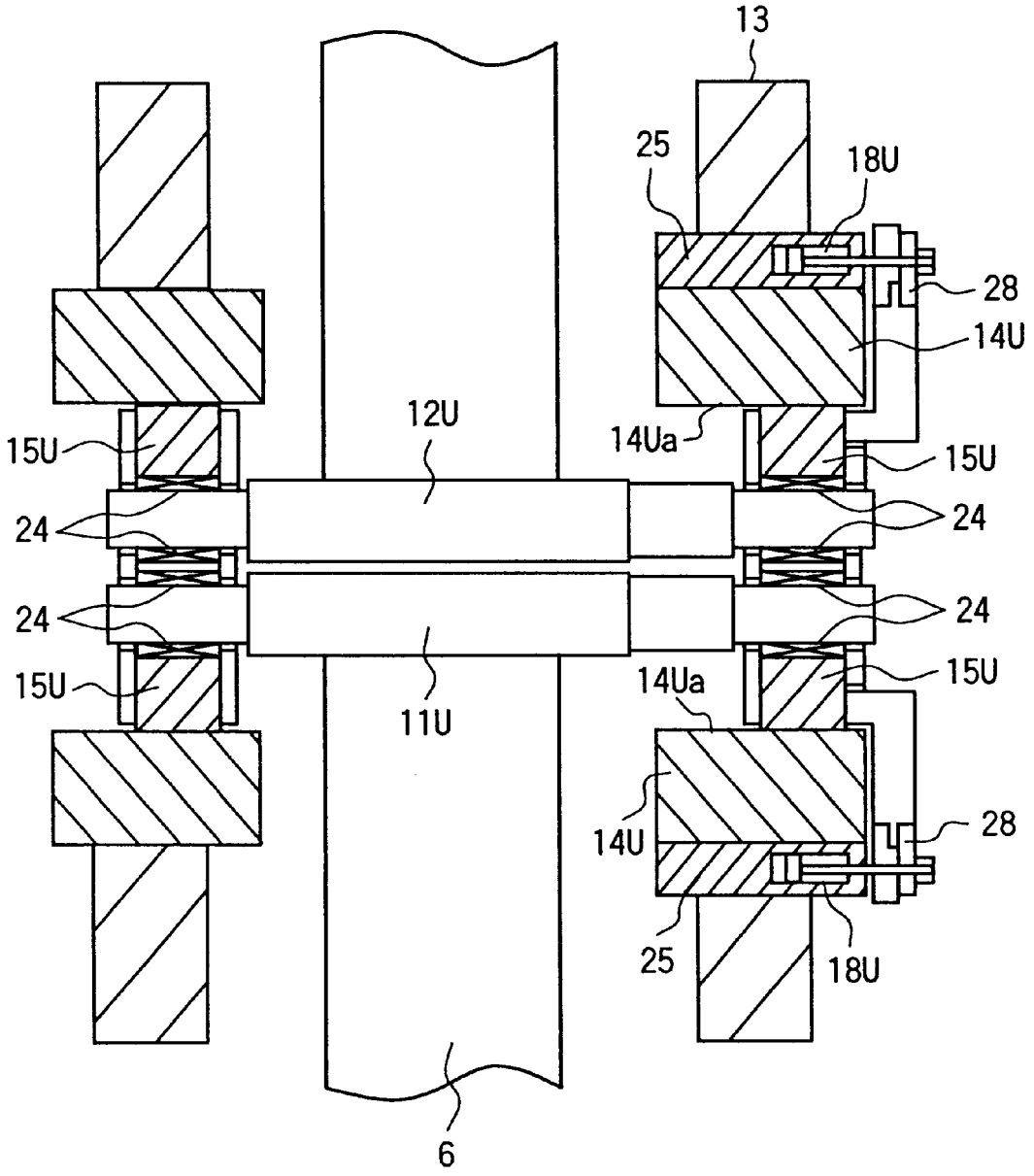
FIG. 4 is a horizontal sectional view of the cluster type rolling mill shown in FIG. 1, showing a supporting mechanism of upper intermediate rolls by upper intermediate roll chocks.

Here, a horizontal sectional view of a support construction of the upper intermediate rolls 9U, 10U by the upper intermediate roll chock 15U is shown in FIG. 4. In FIG. 4, a right side is an operation side and a left side is a driving side. In FIG. 4, the upper intermediate rolls 9U, 10L are held by 4-row tapered roller bearings 24 incorporated into the upper roll chocks 15U. The upper intermediate roll chocks 15U on the operation side are connected to the above-mentioned hydraulic cylinders 18U embedded in project blocks 25 mounted on the housing 13 through keeper plates 28, respectively. By expansion and contraction of the hydraulic cylinders 18, the upper intermediate roll chocks 15U and the upper intermediate rolls 9U, 10U are assembled to be one-piece like and moved in the roll axial direction, while being guided by the inner surfaces 14Ua of the upper backing roll chocks 14U as guide faces.

Although detailed explanation is omitted, the lower intermediate roll chocks 15L and lower intermediate rolls 9L, 10L also are constructed as above, and the lower intermediate roll chocks 15L and lower intermediate rolls 9L, 10L are movable in the roll axial direction while being guided by inner surfaces of the lower backing roll chocks 14L as guide faces.

Referring back to FIG. 1 and FIG. 3, the work roll chocks 16U, 16L are held by the upper intermediate roll chocks 15U, 15L so as to be embraced thereby, respectively. Bending force can be applied to the work rolls 8U, 8L through the work roll chocks 9U, 9L by expansion or contraction of the hydraulic cylinders 20. Further, bearings 30 (refer to FIG. 3) provided on a door of opening and closing type mounted on the housing 13 bear thrust force from the work rolls 8U, 8L.

Next, operation of the rolling mill with the above construction will be explained hereunder.

(1) Improvement of Shape Controllability by Control of Work Roll Deflection:

In the cluster type rolling mill 3 according to the present embodiment, the two pairs of intermediate rolls 9U, 9L, 10U, 10L on the upper and lower sides and the two pairs of backing rolls 11U, 11L, 12U, 12L on the upper and lower sides support the work rolls on the upper and lower sides, whereby a rolling load is supported at an angle in a range of, for example, 40 to 55° to a line passing the work roll axes on each of entry and exit sides. That is, the rolling load loaded on the work rolls 8U and 8L is distributed to and loaded on the upper and lower intermediate rolls 9U, 10U and 9L, 1OL and further transmitted to the upper and lower backing rolls 11U, 12U and 11L, 12L. Further, force from the upper backing rolls 11U, 12U is transmitted to the housing 13 through the upper backing roll chocks 14U and the pass line adjusting apparatus 22, and force from the lower backing rolls 11L, 12L is transmitted to the housing 13 through the lower backing roll chocks 14L and the screw-down device 13. With such a cluster type load supporting construction, horizontal deflection of the work rolls 8U, 8L, caused by components of driving tangential force horizontally applied from the intermediate rolls 9U, 10U, 9L, 10L can be suppressed and it is possible to stably cope with a large change in driving torque.

At this time, a load distribution is optimized by imparting desired or predetermined profiles to the intermediate rolls 9U, 9L, 10U, 10L by axially shifting the intermediate rolls 9U, 9L, 10U, 10L, whereby the deflection of the work rolls 8U, 8L can be further suppressed. At this time, in addition thereto, bending force is applied to the intermediate rolls 9U, 9L, 10U, 10L and the work rolls 8U, 8L by the hydraulic cylinders 19U, 19L and the hydraulic cylinders 20, whereby the deflection of the work rolls 8U, 8L can be further sufficiently suppressed, and a good shape control can be effected. That is, deflection of the work rolls 8U, 8L can be sufficiently suppressed without using an AS-U mechanism, so that the intermediate rolls 9U, 9L, 10U, 10L and the backing rolls 11U, 11L, 12U, 12L each can be a roll of one piece.

(2) Further Improvement of Shape Control:

As explained on the above item (1), in the cluster type rolling mill 3 of the present embodiment, the work rolls 8U, 8L are supported by the cluster type load supporting construction. The intermediate rolls 9U, 9L, 10U, 10L are made to be shifted in the axial direction and bending force is applied on the intermediate rolls 9U, 9L, 10U, 10L and work rolls 8U, 8L, whereby deflection of the work rolls 8U, 8L is sufficiently suppressed and a good shape control is effected. At this time, by limiting the roll diameters of the intermediate rolls 9U, 9L, 10U, 10L and the backing rolls 11U, 11L, 12U, 12L to a certain range, the above-mentioned operation by the axial shift and roll bending are effectively executed, good shape control is surely carried out and deflection of the work rolls 8U, 8L is surely suppressed. This is explained referring to FIG. 5.

FIGS. 5A to 5C each show shapes of a strip 6 obtained by numeral analysis in the case where the strip 6 of width 1000 mm is rolled from thickness of 1.0 mm to thickness 0.7 mm under a rolling load of 350 ton and under a rolling load of 150 ton, using the same rolling mill (hereunder, each element is referred to by the same symbol as in the rolling mill 3) as the cluster type rolling mill 3 of the present embodiment, changing the roll diameters of the intermediate rolls 9U, 9L, 10U, 10L and backing rolls 11U, 11L, 12U, 12L and changing deformation resistance of the strip 6. Further, in each of FIGS. 5A to 5C, Fw is a load applied by the work roll bender, Fi is a load applied by the intermediate roll bender, UCδ is a shift quantity of intermediate roll and Cb is a crown quantity.

In any of FIGS. 5A to 5C, the diameter of the work rolls 8U, 8L is fixed to be 100 mm, however, the diameter of the intermediate rolls 9U, 9L, 10U, 10L and the diameter of the backing rolls 11U, 11L, 12U, 12L are 280 mm and 860 mm, respectively in FIG. 5A, 240 mm and 700 mm, respectively in FIG. 5B and 200 mm and 600 mm, respectively in FIG. 5C. In each of FIGS. 5A to 5C, rolling load was 350 ton and 150 ton.

Observing FIGS. 5A to 5C under the same rolling load, when the rolling load is 150 ton, the plate shape is controlled to be relatively good in any cases. However, when the rolling load is 350 ton, as the roll diameters of the intermediate rolls 9U, 9L, 10U, 10L and backing rolls 11U, 11L, 12U, 12L become smaller (FIG. 5A→5B→45C), the plate shape becomes worse and preferable plate shape is not always obtained in a necessary load range. That is, although a relatively good plate shape can be obtained in FIGS. 5A and 5B, complex elongation appears and the plate shape worsens largely in FIG. 5C. Thereby it is noted that the diameter of the intermediate rolls 9U, 9L, 10U, 10L and the diameter of the backing rolls 11U, 11L, 12U, 12L are preferable to be 240 mm or more and 700 mm or more, respectively. However, the threshold values slightly change by combination of the diameter of the intermediate rolls 9U, 9L, 10U, 10L and the diameter of the backing rolls 11U, 11L, 12U, 12L. Therefore, taking this change into consideration, the inventors concluded that preferable ranges of the diameter of the intermediate rolls 9U, 9L, 10U, 10L and the diameter of the backing rolls 11U, 11L, 12U, 12L are 220 mm or more and 650 mm or more, respectively. In the case where the intermediate rolls 9U, 9L, 10U, 10L and the backing rolls 11U, 11L, 12U, 12L which are finer in diameter than the above preferable ranges are used, the AS-U mechanism using the division type backing rolls becomes necessary and the surface quality is worsened due to mark transfer On the other hand, when the diameter of the intermediate rolls 9U, 9L, 10U, 10L is made larger than 320 mm and the diameter of the backing rolls 11U, 11L, 12U, 12L is made larger than 900 mm, it was found that a space between the rolls becomes narrow and the cluster type roll arrangement as mentioned above becomes difficult. Therefore, in order to obviate occurrence of such a structural problem, it is preferable that the diameter of the intermediate rolls 9U, 9L, 10U, 10L is 320 mm or less and the diameter of the backing rolls 11U, 11L, 12U, 12L is 900 mm or less.

Further, when driving tangential force acts on the work rolls 8U, 8L from the intermediate rolls 9U, 9L, 10U, 10L, at the same time, the intermediate rolls 9U, 9L, 10U, 10L receive the reaction force corresponding to the driving tangential force, so that in the case where the diameter of the intermediate rolls 9U, 9L, 10U, 10L is too fine, the intermediate rolls 9U, 9L, 10U, 10L are subjected to horizontal bending by the tangential force, and at least three support rollers are necessary to support them, whereby geometrical restriction to the roll diameter becomes severe for the roll arrangement. Therefore, in the case of rolling of a strip of 1000 mm width, in order not to influence deflection of the intermediate rolls 9U, 9L, 10U, 10L on the rolling by their own rigidity under only support of the intermediate roll chocks 15U, 15L, the diameter of the intermediate rolls 9U, 9L, 10U, 10L is necessary to be 200 mm or more.

From the above, it was found that the diameter of the intermediate rolls 9U, 9L, 10U, 10L is 220 mm to 320 mm, and the diameter of backing rolls 11U, 11L, 12U, 12L is 650 mm to 900 mm.

In the rolling mill 3 of the present embodiment, each of the diameter of the work rolls 8U, 8L and the diameter of the intermediate rolls 9U, 9L, 10U, 10L is 280 mm and the diameter of the backing rolls 11U, 11L, 12U, 12L is 860 mm, and those diameters are within the above range. Thereby, it is possible to surely carry out good shape control by effectively working the above-mentioned action by the axial shift and the roll bending and to surely suppress the deflection of the work rolls 8U, 8L.

Further, the above-mentioned preferable range of roll diameter is considered to be established typically, in the case where a plate 800 mm wide is rolled within 120 mm range of roll diameter of the work rolls 8U, 8L which is so-called small diameter work roll.

(3) Improvement of the Plate Passing Facility and Direct Detection of a Rolling Load:

In the rolling mill 3 of the present embodiment, a load to the backing rolls 11U, 11L, 12U, 12L is dispersed into the entry side and the exit side by providing two pairs of backing rolls 11U, 11L, 12U, 12L on the upper and lower sides. However, the horizontal force loaded on the backing rolls 11U, 11L, 12U, 12L through the intermediate rolls 9U, 9L, 10U, 10L can be received as inner force of the upper and lower backing roll chocks 14U, 14L, respectively as mentioned on the above item (1) by supporting the upper backing rolls 11U, 12U by the upper backing roll chock 14U and the lower backing rolls 11L, 12L by the lower backing roll chock 14L, respectively. As such, the vertical force can be supported by the housing 13 as in the conventional 6-high rolling mill. Further, the work roll chocks 16U, 16L are held by the intermediate roll chocks 15U, 15L and the intermediate roll chocks 15U, 15L are held by the backing roll chock 14U, 14L. However, since the backing roll chocks 14U, 14L are movable in the housing in the up and down directions, rolls on each of the upper and lower sides of the work rolls 4U, 8L, the intermediate rolls 9U, 9L, 1oU, 10L and the backing rolls 11U, 11L, 12U, 12L are integratedly movable in the housing 13 in the up and down directions. Therefore, since those rolls can be separated into a roll group on the upper side and a roll group on the lower side to provide a wide space at the time of plate passage, a good plate passing facility can be secured, and the productivity can be raised. Further, a large flexibility can be given in the up and down directions for change in roll diameter. Further, since provision of the load cells 21 on the upper portions of the upper backing roll chocks 14U enables direct detection of a rolling load and facilitates thickness control, plate thickness precision can be improved.

As mentioned above, in the rolling mill 3 of the present embodiment, since the intermediate rolls 9U, 9L, 10U, 10L and the backing rolls 11U, 11L, 12U, 12L each can be made in one-piece roll, the problem of transfer of marks of a division type roll as in the conventional 20-stage Senzdimir rolling mill and 10-stage rolling mill are solved and good surface quality can be secured. Further, differing from the conventional 6-high rolling mill, reversible rolling and rolling with large change in rolling torque can be coped with by simple control, so that the production efficiency is not lowered.

Further, in the above embodiment, the load cells 21 are provided on the upper portion of the upper backing roll chocks 14U as detecting means. The detecting means is not limited to the above arrangement, but the construction that the detecting means are provided on the lower portions of the lower backing roll chock 14L is also considered.

Further, in the present invention, without being restricted to the above embodiment, various modifications are considered as long as the conception is maintained. Those modifications will be explained in turn, referring to the drawings. In the modifications, common parts to the rolling mill shown in FIGS. 1 to 4 are given the same symbols, and modified parts are given suffixes such as A to E in the order of description of the modifications.

Figure 6:
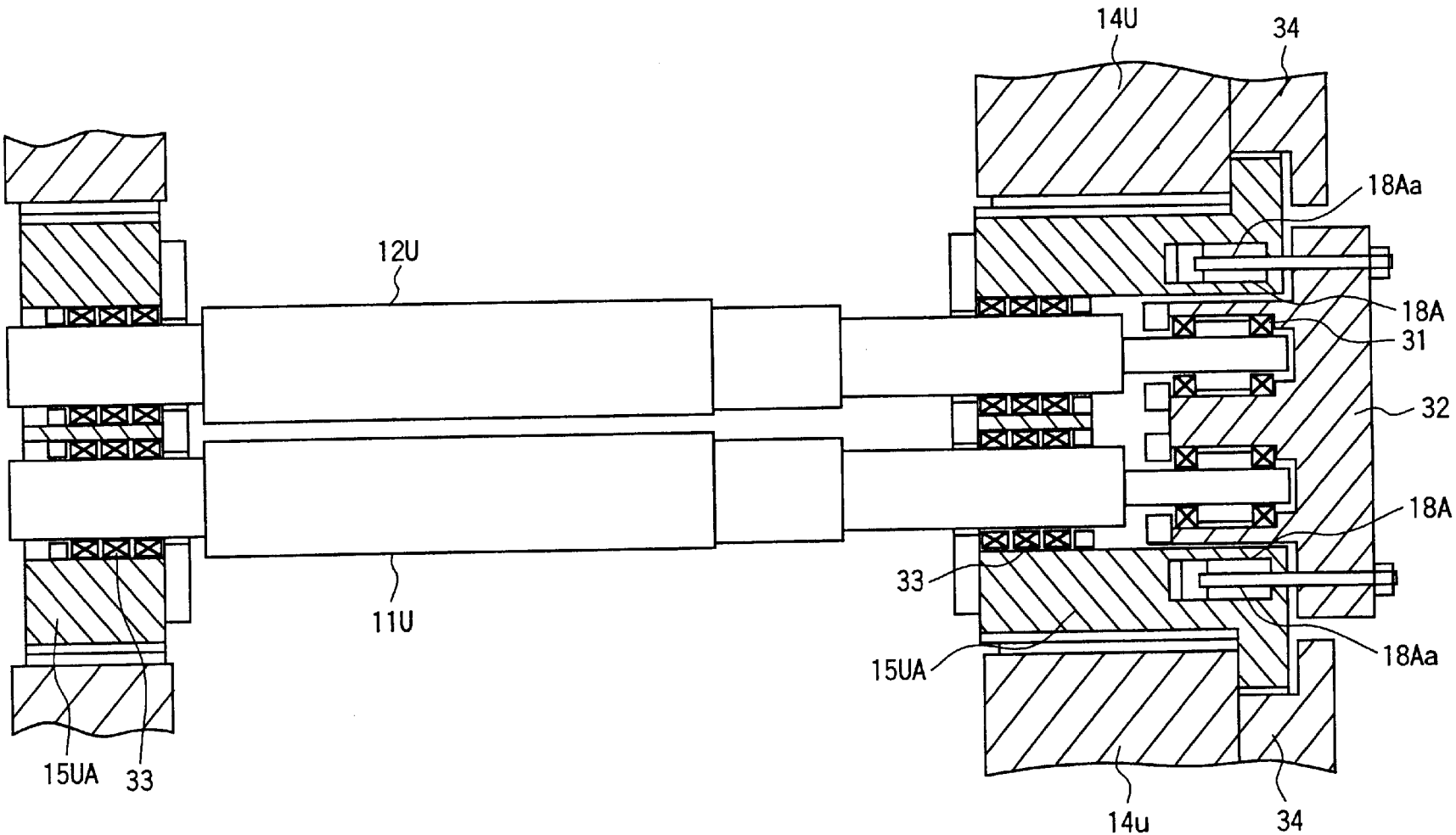
FIG. 6 is a horizontal sectional view of a modification of the rolling mill in which intermediate rolls are shifted in the axial direction relative to intermediate roll chocks.

(I) Axial Shift of Intermediate Roll to an Intermediate Roll Chock:

The axial shift in this case is such that both of the intermediate roll chocks 15U, 15L and the intermediate rolls 9U, 9L, 10U, 10L are not driven to axially shift. Rather the intermediate roll chocks 15U, 15L are fixed and only the intermediate rolls 9U, 9L, 10U, 10L are axially shifted. A horizontal sectional view is shown FIG. 6, illustrating a support construction in the vicinity of the upper intermediate roll chocks 15U in this modification. FIG. 6 is a view corresponding to FIG. 4, and in FIG. 6, the right side is an operation side and the left side is a driving side.

In FIG. 6, hydraulic cylinders 18A for axially shifting the upper intermediate rolls 9U and 10U are embedded in upper intermediate roll chocks 15UA on the operation side, respectively. The upper intermediate rolls 9U, 10U are engaged with a slider 32 through thrust bearings 31 provided at their roll ends, and the slider 32 is engaged with rod portions 18Aa of the hydraulic cylinders 18A. The upper intermediate rolls 9U, 10U are axially shifted in radial bearings 33 provided in the upper intermediate roll chocks 15UA by expansion and contraction of the hydraulic cylinders 18A. At this time, the upper intermediate rolls chocks 15UA are engaged with the upper backing roll chock 14U by upper intermediate roll chock keeper plates 34.

Further, although particular detailed explanation is not given, a similar construction is taken for the lower intermediate roll chocks, whereby the lower intermediate rolls 11L, 12L can be shifted in the axial direction.

Figure 7:
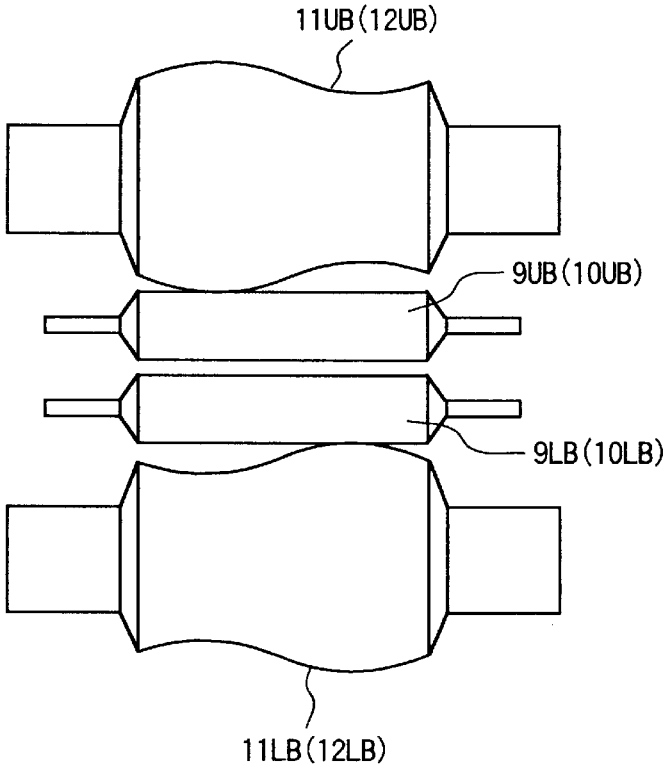
FIG. 7 is a schematic view of a modification of the rolling mill in which each backing roll has a predetermined profile given thereto.

(II) Imparting Predetermined Profile to Backing Roll:

As shown in FIG. 7, a profile is provided between the upper and lower backing rolls 11UB, 11LB on the entry side and between the upper and lower backing rolls 12UB, 12LB such that roll curves are in compensating relations with each other. Thereby, the following effect is brought about:

When the width of a plate 6 becomes largely wide, there may occur a case where only the functions of shifting of the intermediate rolls and bending the work rolls and intermediate rolls, as explained on the above item (I) are insufficient for controlling the shape at the central portion of the plate 6. In such a case, by forming the profiles of the backing rolls 11UB, 11LB, 12UB, 12LB so that roll curves are in a compensating relation with each other as mentioned above, the shape at the central portion of the plate 6 can also be adjusted well by geometrical action of the profiles by providing, for example, a similar construction to the hydraulic cylinders 18U, 18L and shifting them in the axial direction opposite to each other.

Further, without forming the compensating relations between the upper and lower backing rolls 11UB 11LB on the entry side and between upper and lower backing rolls 12UB, 12LB on the exit side, it is sufficient to form compensating relation between the upper backing roll hUB on the entry side and the lower backing roll 12LB on the exit side and between the lower backing roll 11LB on the entry side and the upper backing roll 12UB on the exit side, and this case also attains the same effect.

Figure 8:
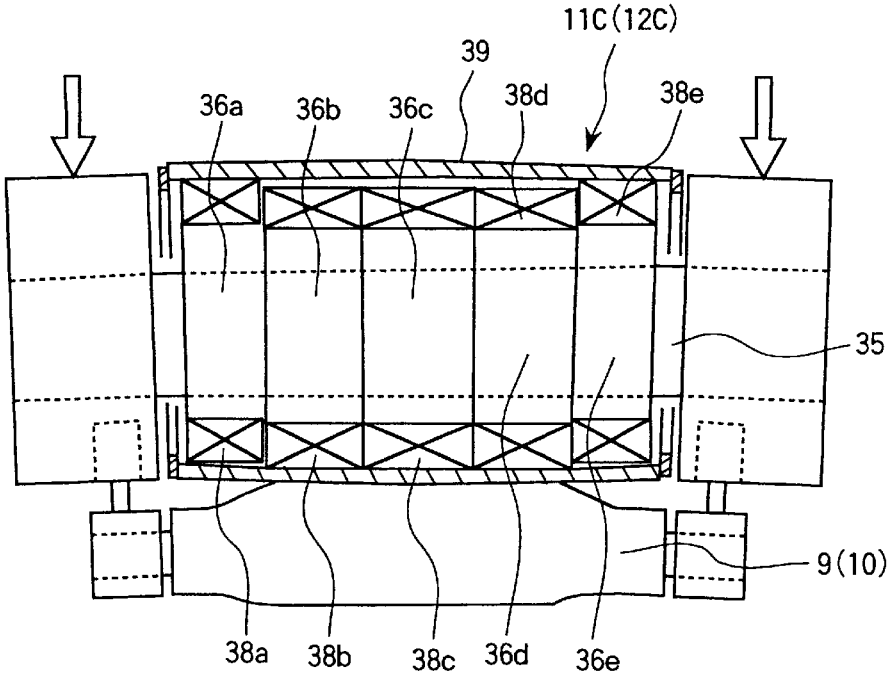
FIG. 8 is a view of a part of the rolling mill which is a modification in which the backing rolls each are made in sleeve roll.

(III) Making Backing Rolls into Sleeve Rolls:

As shown in FIG. 8, a least one backing roll 11C (or 12C, hereunder the same) comprises a common roll shaft 35, a plurality of divided barrel portions (here, 5 divided barrel portions) 36*a* to 36*e* mounted on the common roll shaft 35 to be eccentric with the common roll shaft and rotatable relative to the common roll shaft 35. Five radial bearings 38*a* to 38*e* are provided on outer peripheries of the divided barrel portions 36*a* to 36*e*, respectively. One sleeve 39 is rotatably provided on the outer side of the divided barrel portions 36*a* to 36*e* through the radial bearings 38*a* to 38*e* and contacting the intermediate rolls 9 (or 10) corresponding thereto.

In the above-mentioned construction, only the sleeve 39 follows the rotation of the intermediate roll 9, at this time, by mounting each of the divided barrel portions 36*a* to 36*e* eccentrically passed through by the common roll shaft 35 on the shaft 35. In this case each divided barrel portion is rotated relative to the shaft 35 by a predetermined angle, a quantity of radial projection of each divided barrel portion 36*a* to 36*e* from the common roll shaft 35 can be controlled. Thereby, even if the width of the strip 6 becomes largely wide as explained above (b), the shape at the central portion of the strip 6 can be sufficiently controlled by adjusting the profile of the sleeve to a desired profile and adjusting crown of the sleeve 39 contacting the intermediate roll 9.

Figure 9:
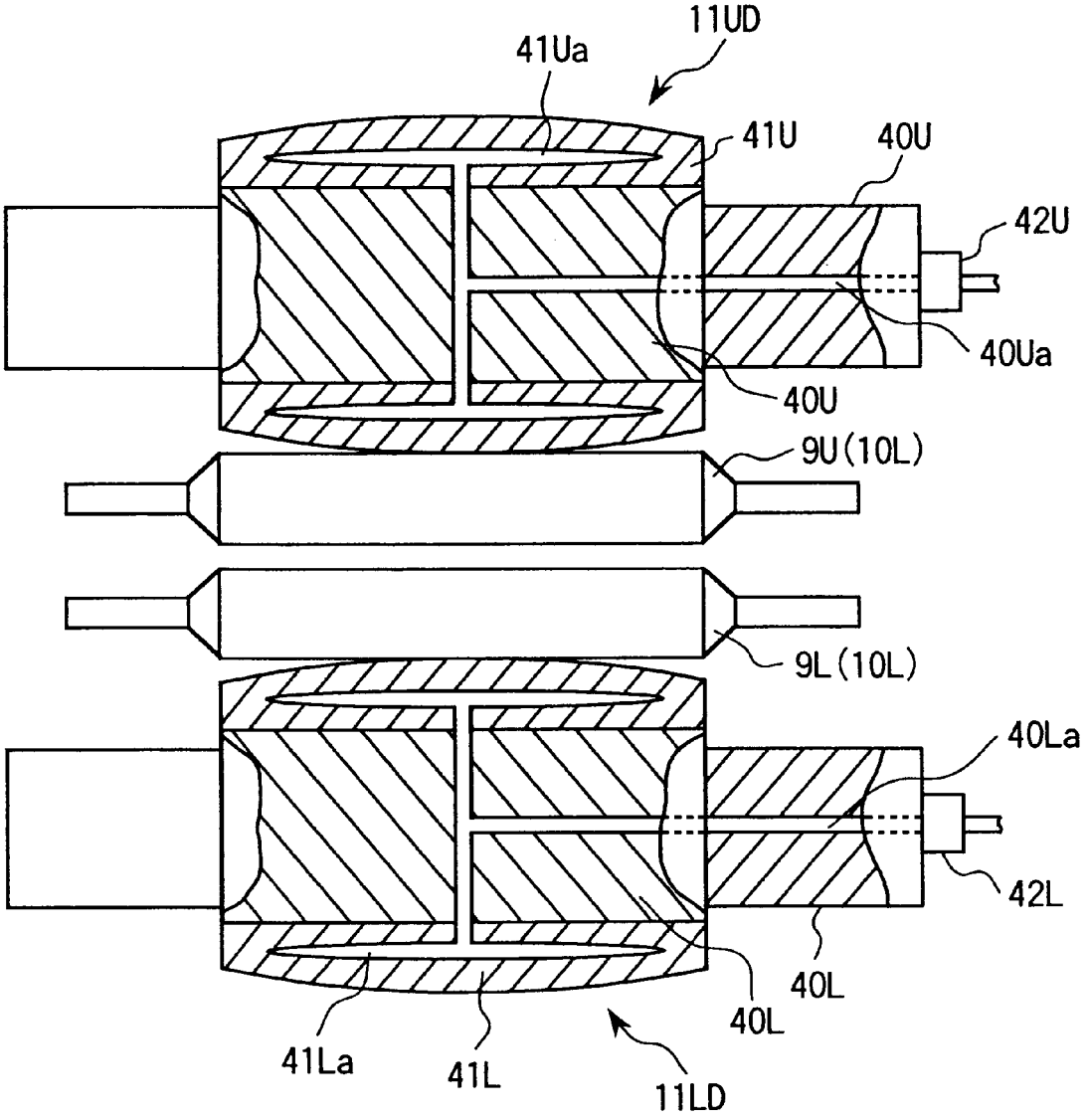
FIG. 9 is a view of a modification of the rolling mill in which a predetermined profile is imparted to the backing roll by hydraulic pressure.

(IV) Imparting a Profile to a Backing Roll by Hydraulic Pressure:

As shown in FIG. 9, at least one pair of backing rolls 11UD, 11LD (or 12UD, 12LD, hereunder the same) are constructed of roll shafts 40U, 40L and sleeves 41U, 41L mounted on the outer peripheries of the roll shafts 40U, 40L and contacting with the corresponding intermediate rolls 9U, 9L (or 10U, 10L). Pressurized oil passages 40Ua, 40La, 41Ua, 41La are provided in the roll shafts 40U, 40L and the sleeves 41U, 41L. The outer diameter profiles of the sleeves 41U, 41L can be adjusted by pressurized oil led there through rotary joints 42U, 42L.

Thereby, even if the width of the strip 6 becomes largely wide as explained above (I), the shape at the central portion of the strip 6 can be sufficiently controlled by expanding, for example, the sleeves 41U, 41L to form the outer diameter profile into a convex shape and adjusting the crown of the backing rolls 11UD, 11LD.

Further, any one of the pair of backing rolls on the upper and lower sides can be constructed as above.

Figure 10:
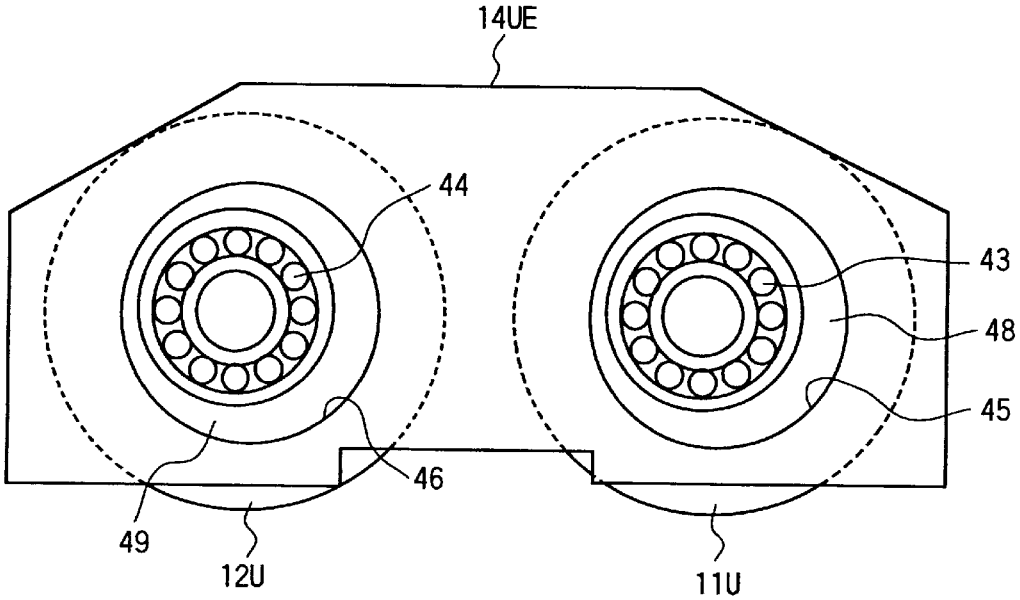
FIG. 10 is a view of a part of the rolling mill modified by providing an eccentrically supporting mechanism on the backing rolls (or intermediate rolls)

(V) An Eccentrically Supporting Structure of Backing Roll Chocks (or intermediate roll chocks):

As shown in FIG. 10, the upper backing roll chock 14UE (or upper backing roll chock 14LE or both of them, hereunder the same) comprises two bearings 43, 44 rotatably supporting the neck portion of the corresponding upper backing rolls 11U, 12U, respectively. Through holes 45 46 are provided corresponding to the supporting position of the upper backing rolls 11U, 12U and two sleeves 48, 49 rotatably mounted in the through holes 45, 46 and holding the bearings 43, 44 eccentrically arranged.

Thereby, the positions of the upper backing rolls 11U, 12U in the pass line direction the height thereof can be adjusted by rotating the each sleeve 48, 49 by a predetermined angle. Further, it is also possible to adjust a distance between the upper backing rolls 11U and 12U so that contact angels between the upper backing rolls 11U, 12U and the intermediate rolls 9U, 10U do not change so much even when roll diameters thereof change, for example by rotating the sleeve 48 on the entry side and the sleeve 49 on the exit side in the opposite directions to each other.

Figure 11:
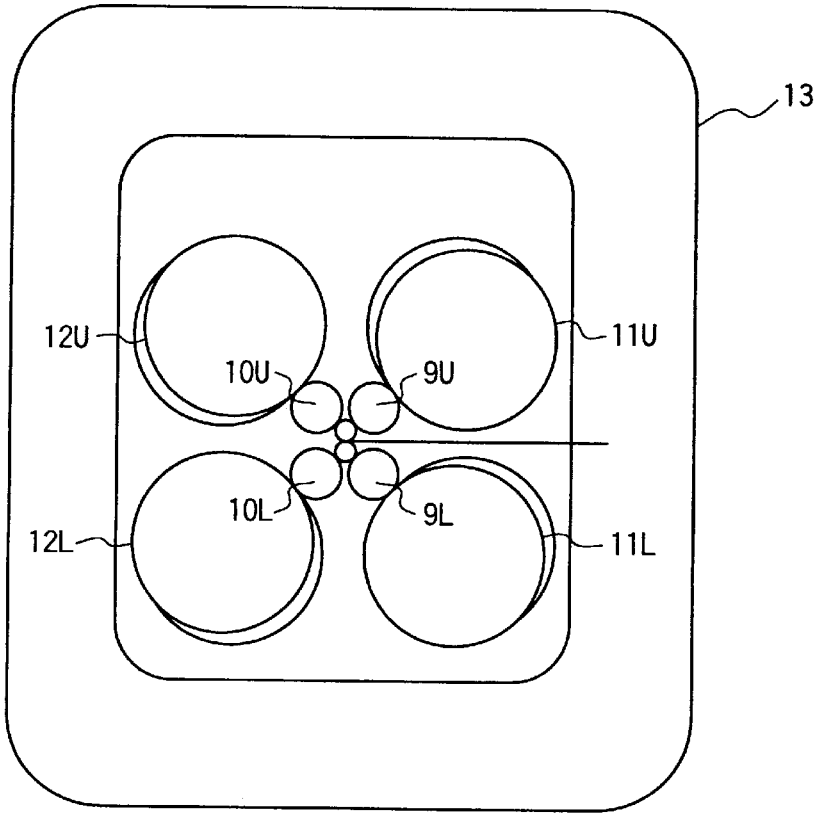
FIG. 11 is a schematic diagram showing a condition in which roll axes of upper backing rolls are inclined at an angle to roll axes of upper intermediate roll.

Further, by using in combination spherical seats for example and rotating the sleeves 48 and 49 in the opposite directions to each other in each of the upper backing roll chocks 14U, 14U on the operation side and driving side, it is possible to incline the axes of the upper backing rolls 11U, 12U to the axes of the upper intermediate rolls 9U, 10U to provide an inclination angle as shown in FIG. 11 (In FIG. 11, the construction on the lower side is also illustrated). Thereby, it is also possible adjust apparent crown of the upper backing rolls 11U, 12U.

Further, it is possible to provide the intermediate rolls with the above structure.

According to the present invention, it is possible to effect an excellent shape control by suppressing deflection of the work rolls without worsening the surface quality of plate, prevent the productivity from being lowered even when rolling torque changes largely, and secure good plate passing facility and directly detect a rolling load.

What is claimed is:

1. A cluster type rolling mill having a pair of work rolls on upper and lower sides of a material traveling path, two pairs of intermediate rolls on the upper and lower sides, said intermediate rolls contacting said work rolls and to impart driving force to said work rolls, and two pairs of backing rolls on the upper and lower sides, said backing rolls contacting and supporting said intermediate rolls, wherein said rolling mill comprises a pair of backing roll chocks on the upper and lower sides, said pair of backing roll chocks supporting two upper backing rolls on the upper side of said two pairs of backing rolls and two lower backing rolls on the lower side of said two pairs of backing rolls and means for moving the backing roll chocks in a housing in an up and down direction, respectively; each of said backing roll chocks being supported by a mill housing to be vertically movable relative to said mill housing and the pair of backing rolls supported by each of said backing roll chocks being spaced from each other in the material traveling path, a pair of intermediate roll chocks on the upper and lower sides, said pair of intermediate roll chocks supporting two upper intermediate rolls on the upper side of said two pairs of intermediate rolls and two lower intermediate rolls on the lower side of said two pairs of intermediate rolls, respectively;

a pair of work roll chocks on the upper and lower sides, said pair of work roll chocks supporting an upper work roll on the upper side of said pair of work rolls and a lower work roll on the lower side of said pair of work rolls, respectively; and means for driving and axially shifting at least said intermediate rolls of said intermediate rolls and said intermediate roll chocks;

intermediate roll bending means and work roll bending means each for applying bending force to said intermediate rolls and said work rolls; and wherein said intermediate rolls and said backing rolls are one piece rolls.

2. A cluster type rolling mill according to claim 1, wherein an axis of each of said backing rolls is positioned on or near a plane passing through an axis of a corresponding work roll and an axis of a corresponding intermediate roll.

3. A cluster type rolling mill according to claim 1, wherein has a diameter of each of said work rolls is 120 mm or less.

4. A cluster type rolling mill according to claim 1, wherein each of said intermediate rolls has a diameter of in a range of 220 mm or more and 320 mm or less, and each of said backing rolls has a diameter in a range of 650 mm or more and 900 mm or less.

5. A cluster type rolling mill according to claim 1, wherein a material being rolled has a width of 800 mm or more.

6. A cluster type rolling mill according to claim 1, wherein a rolling load is about in a range of 150 ton or more and 350 ton or less.

7. A cluster type rolling mill according to claim 1, wherein said driving means is provided on said intermediate roll chocks for shifting said intermediate rolls in an axial direction to said intermediate roll chocks.

8. A cluster type rolling mill according to claim 1, wherein profiles are provided between the upper backing roll on an entry side and the backing roll on an exit side and between the lower backing roll on the entry side and the lower backing roll on the exit side, or between the upper and lower backing rolls on the entry side and between upper and lower backing rolls on the exit side such that roll curves are in compensating relations to each other.

9. A cluster type rolling mill according to claim 1, wherein at least one of said backing rolls comprises a first common roll shaft, a plurality of division barrel portions eccentrically passed through by said first common roll shaft and rotatably mounted on said first common roll shaft, a plurality of first bearings provided on respective peripheries of said division barrel portions, respectively, a first sleeve rotatably provided on an outer peripheral side of said plurality of division barrel portions through said plurality of first bearings and contacting with the corresponding one or ones of said intermediate rolls.

10. A cluster type rolling mill according to claim 1, wherein at least one of said backing rolls has a second roll shaft, and a second sleeve provided on a outer periphery of said second roll shaft and contacting a corresponding one or ones of said intermediate rolls, said second sleeve having an inside with a pressurized oil passage and being constructed so that an outer diameter profile of said second sleeve is adjusted with pressurized oil led thereto.

11. A cluster type rolling mill according to claim 1, wherein at least one of said backing roll chocks and said intermediate roll chocks has two second bearings rotatably supporting corresponding said backing rolls or intermediate rolls, two through holes provided corresponding to the supporting positions of said corresponding backing rolls or intermediate rolls and two third sleeves rotatably provided inside said through holes and eccentrically arranging said second bearings.

12. A cluster type rolling mill having a pair of work rolls on upper and lower sides of a material traveling path, two pairs of intermediate rolls on the upper and lower sides, said intermediate rolls contacting said work rolls to impart driving force to said work rolls, and two pairs of backing rolls on the upper and lower sides, said backing rolls contacting and supporting said intermediate rolls, wherein said rolling mill comprises a pair of backing roll chocks on the upper and lower sides, said pair of backing roll chocks supporting two upper backing rolls on the upper side of said two pairs of backing rolls and two lower backing rolls on the lower side of said two pairs of backing rolls, respectively; each of said backing roll chocks being supported by a mill housing to be vertically movable relative to said mill housing and the pair of backing rolls supported by each of said backing roll chocks being spaced from each other in the material traveling oath, a pair of intermediate roll chocks on the upper and lower sides, said pair of intermediate roll chocks supporting two upper intermediate rolls on the upper side of said two pairs of intermediate rolls and two lower intermediate rolls on the lower side of said two pairs of intermediate rolls, respectively;

a pair of work roll chocks on the upper and lower sides, said pair of work rolls supporting an upper work roll on the upper side of said pair of work rolls and a lower work roll on the lower side of said pair of work rolls, respectively;

means for driving and axially shifting at least said intermediate rolls of said intermediate rolls and said intermediate roll chocks; and intermediate roll bending means and work roll bending means each for applying bending force to said intermediate rolls and said work rolls.

13. A cluster type rolling mill having a pair of work rolls on upper and lower sides of a rolling material travelling path, two pairs of intermediate rolls on the upper and lower sides, contacting and driving said work rolls, and two pairs of backing rolls on the upper and lower sides, contacting and supporting said intermediate rolls, wherein said rolling mill comprises a pair of backing roll chocks on the upper and lower sides, supporting two upper backing rolls and two lower backing rolls of said two pairs of backing rolls, respectively; each of said backing roll chocks being supported by a mill housing to be vertically movable relative to said mill housing and the pair of backing rolls supported by each of said backing roll chocks being spaced from each other in the material traveling path, a pair of intermediate roll chocks on the upper and lower sides, supporting two upper intermediate rolls and two lower intermediate rolls of said two pair of intermediate rolls, respectively, and held by said pair of backing rolls, respectively;

a pair of work roll chocks on the upper and lower sides, supporting an upper work roll and a lower work roll of said pair of work rolls, respectively, and held by said pair of intermediate roll chocks, respectively;

driving means for driving and axially shifting at least said intermediate rolls among said intermediate rolls and said intermediate roll chocks;

intermediate roll bending means and work roll bending means for applying bending force to said intermediate rolls and said work rolls; and wherein each of said work rolls has a diameter of 120 mm or less, each of said intermediate rolls has a diameter of 220–320 mm and each of said backing rolls has a diameter of 650–900 mm.

14. A rolling method by a cluster type rolling mill having a pair of work rolls on upper and lower sides of a rolling material travelling path, two pairs of intermediate rolls on upper and lower sides, contacting and driving said work rolls, and two pairs of backing rolls on the upper and lower sides, contacting and supporting said intermediate rolls, each pair of said backing rolls being being supported in respective backing roll chocks at a mill housing to be vertically movable relative to said housing, wherein axial shifting means for shifting the intermediate rolls in an axial direction accommodate rolling of the strip shifting said intermediate rolls in the axial direction, and wherein bending means are provided for applying bending force to said intermediate rolls and said work rolls.

15. A rolling method by a cluster type rolling mill having a pair of work rolls on upper and lower sides of a rolling material travelling path, two pairs of intermediate rolls on the upper and lower sides, contacting and driving said work rolls, and two pairs of backing rolls on the upper and lower sides, contacting and supporting said intermediate rolls, each pair of said backing rolls being supported in respective backing roll chocks at a mill housing to be vertically movable relative to said housing, wherein a strip is rolled by applying bending force to said intermediate rolls while shifting said intermediate rolls in an axial direction, and setting a diameter of each work roll to 120 mm or less and applying bending force to said work rolls.

16. A rolling method by a cluster type rolling mill having a pair of work rolls on upper and lower sides of a rolling material travelling path, two pairs of intermediate rolls on the upper and lower sides, contacting and driving said work rolls, two pairs of backing rolls on the upper and lower sides, contacting and supporting said intermediate rolls, and a pair of backing roll chocks on the upper and lower sides, supporting two upper backing rolls and two lower backing rolls of said two pairs of backing rolls, respectively, each of said backing roll chocks being supported by a mill housing to be vertically movable relative to said mill housing and the pair of backing rolls supported by each of said backing roll chocks being spaced from each other in the material traveling path, wherein a strip is rolled by detecting a rolling load at the positions of said backing roll chocks;

on the basis of the detected rolling load, shifting said intermediate rolls in the axial direction and applying bending force to said intermediate rolls and said work rolls; and controlling the thickness of the strip.

17. A rolling method of rolling a strip by supporting two pairs of intermediate rolls on upper and lower sides by two pairs of backing rolls on the upper and lower sides, driving a pair of work rolls on upper and lower sides by driving force from said two pairs of intermediate rolls, wherein a strip is rolled by supporting two upper backing rolls and two lower backing rolls of said two pairs of backing rolls by a pair of backing roll chocks on the upper and lower sides, respectively, each of said backing roll chocks being supported by a mill housing to be vertically movable relative to said mill housing and the pair of backing rolls supported by each of said backing roll chocks being spaced from each other in the material traveling path, supporting two upper intermediate rolls and two lower intermediate rolls of said two pair of intermediate rolls by a pair of intermediate roll chocks on the upper and lower sides, said pair of intermediate roll chocks being held by said pair of backing roll chocks, respectively;

supporting the upper work roll and the lower work roll of said pair work rolls by a pair of work roll chocks on the upper and lower sides, said pair of work roll chocks being held by said pair of intermediate roll chocks, respectively;

and shifting said intermediate rolls in the axis direction and while applying bending force to said intermediate rolls and said work rolls.

18. A cluster type rolling mill having a pair of work rolls on upper and lower sides of a material traveling path, two pairs of intermediate rolls on the upper and lower sides, one pair of said intermediate rolls on the upper side each contacting one of said work rolls on the upper side to impart driving force thereto and another pair of said intermediate rolls on the lower side each contacting another of said work rolls to impart driving force thereto, two pairs of backing rolls on the upper and lower sides, said backing rolls contacting and supporting said intermediate rolls, and a housing holding said work rolls, intermediate rolls and backing rolls, wherein said rolling mill comprises:

an upper backing roll chock, provided on each axial roll end portion so as to be supported by said housing to be vertically movable, and supporting one pair of said backing rolls on the upper side;

a lower backing roll chock, provided on each axial roll end portion so as to be supported by said housing to be vertically movable, and supporting another pair of said backing rolls on the lower side;

an upper intermediate roll chock, provided on each axial roll end portion so as to be embraced by said upper backing roll chock and vertically movable, and supporting one pair of said intermediate rolls on the upper side;

a lower intermediate roll chock, provided on each axial roll end portion so as to be embraced by said lower backing roll chock and vertically movable, and supporting another pair of said intermediate rolls on the lower side;

an upper work roll chock, provided on each axial roll end portion so as to be embraced by said upper intermediate roll chock to be vertically movable, and supporting the upper one of said work rolls on the upper side;

a lower work roll chock, provided on each axial roll end portion so as to be embraced by said lower intermediate roll chock to be vertically movable, and supporting the lower one of said work rolls on the lower side;

means for axially shifting said upper and lower intermediate roll chocks;

intermediate roll bending means for applying bending force to said upper and lower intermediate rolls; and work roll bending means for applying bending force to said work rolls, and wherein said upper and lower intermediate roll chocks are axially shiftable and connected to said means for axially shifting.

19. A cluster type rolling mill having a pair of work rolls on upper and lower sides of a material traveling path, two pairs of intermediate rolls on the upper and lower sides, one pair of said intermediate rolls on the upper side each contacting one of said work rolls on the upper side to impart driving force thereto and another pair of said intermediate rolls on the lower side each contacting another of said work rolls to impart driving force thereto, two pairs of backing rolls on the upper and lower sides, said backing rolls contacting and supporting said intermediated rolls, and a housing holding said work rolls, intermediate rolls and backing rolls, wherein said rolling mill comprises:

an upper backing roll chock, provided on each axial roll end portion so as to be supported by said housing to be vertically movable, and supporting one pair of said backing rolls on the upper side, said one pair of backing rolls being spaced from each other in the material traveling direction;

a lower backing roll chock, provided on each axial roll end portion so as to be supported by said housing to be vertically movable, and supporting another pair of said backing rolls on the lower side, said pair of backing rolls being spaced from each other in the material traveling direction;

an upper intermediate roll chock, provided on each axial roll end portion so as to be axially shiftable and vertically movable, and supporting one pair of said intermediate rolls on the upper side;

a lower intermediate roll chock, provided on each axial roll end portion so as to be axially shiftable and vertically movable, and supporting another pair of said intermediate rolls on the lower side;

an upper work roll chock, provided on each axial roll end portion so as to be vertically movable, and supporting the upper one of said work rolls on the upper side;

a lower work roll chock, provided on each axial roll end portion so as to be vertically movable, and supporting the lower one of said work rolls on the lower side;

means for axially shifting said upper and lower intermediate roll chocks;

intermediate roll bending means for applying bending force to said upper and lower intermediate rolls; and work roll bending means for applying bending force to said work rolls.

20. A cluster type rolling mill according to claim 18, wherein said intermediate rolls on the upper and lower sides and said intermediate roll chocks mounted on both end portions thereof form an upper assembly and a lower assembly, respectively, and each of said upper and lower assemblies being laterally inserted in said housing and connected to said housing by said means for axially shifting.

21. A cluster type rolling mill according to claim 19, wherein said intermediate rolls on the upper and lower sides and said intermediate roll chocks mounted on both end portions thereof form an upper assembly and a lower assembly, respectively, and each of said upper and lower assemblies being laterally inserted in said housing and connected to said housing by said means for axially shifting.

22. A cluster type rolling mill having a pair of work rolls on upper and lower sides of a material traveling path, two pairs of intermediate rolls on the upper and lower sides, said intermediate rolls contacting said work rolls and to impart driving force to said work rolls, and two pairs of backing rolls on the upper and lower sides, said backing rolls contacting and supporting said intermediate rolls, wherein said rolling mill comprises a pair of backing roll chocks on the upper and lower sides, said pair of backing roll chocks supporting two upper backing rolls on the upper side of said two pairs of backing rolls and two lower backing rolls on the lower side of said two pairs of backing rolls and means for moving the backing roll chocks in a housing in an up and down direction, respectively;

a pair of intermediate roll chocks on the upper and lower sides, said pair of intermediate roll chocks supporting two upper intermediate rolls on the upper side of said two pairs of intermediate rolls and two lower intermediate rolls on the lower side of said two pairs of intermediate rolls, respectively;

a pair of work roll chocks on the upper and lower sides, said pair of work roll chocks supporting an upper work roll on the upper side of said pair of work rolls and a lower work roll on the lower side of said pair of work rolls, respectively;

means for driving and axially shifting at least said intermediate rolls of said intermediate rolls and said intermediate roll chocks; and intermediate roll bending means and work roll bending means each for applying bending force to said intermediate rolls and said work rolls; and wherein said intermediate rolls and said backing rolls each are one piece rolls, and wherein at least one of said backing rolls comprises a first common roll shaft, a plurality of division barrel portions eccentrically passed through by said first common roll shaft and rotatably mounted on said first common roll shaft, a plurality of first bearings provided on the peripheries of said division barrel portions, respectively, a first sleeve rotatably provided on the outer peripheral side of said plurality of division barrel portions through said plurality of first bearings and contacting with the corresponding one or ones of said intermediate rolls.

23. A cluster type rolling mill having a pair of work rolls on upper and lower sides of a material traveling path, two pairs of intermediate rolls on the upper and lower sides, said intermediate rolls contacting said work rolls to impart driving force to said work rolls, and two pairs of backing rolls on the upper and lower sides, said backing rolls contacting and supporting said intermediate rolls, wherein said rolling mill comprises a pair of backing roll chocks on the upper and lower sides, said pair of backing roll chocks supporting two upper backing rolls on the upper side of said two pairs of backing rolls and two lower backing rolls on the lower side of said two pairs of backing rolls and means for moving the backing roll chocks in a housing in an up and down direction, respectively;

a pair of intermediate roll chocks on the upper and lower sides, said pair of intermediate roll chocks supporting two upper intermediate rolls on the upper side of said two pairs of intermediate rolls and two lower intermediate rolls on the lower side of said two pairs of intermediate rolls, respectively;

a pair of work roll chocks on the upper and lower sides, said pair of work roll chocks supporting an upper work roll on the upper side of said pair of work rolls and a lower work roll on the lower side of said pair of work rolls, respectively;

means for driving and axially shifting at least said intermediate rolls of said intermediate rolls and said intermediate roll chocks;

intermediate roll bending means and work roll bending means each for applying bending force to said intermediate rolls and said work rolls; and wherein said intermediate rolls and said backing rolls each are one piece rolls, and wherein at least one of said backing rolls has a second roll shaft, and a second sleeve provided on the outer periphery of said second roll shaft and contacting with the corresponding one or ones of said intermediate rolls, said second sleeve having inside a pressurized oil passage and being constructed so that an outer diameter profile of said second sleeve can be adjusted with pressurized oil led thereto.

24. A cluster type rolling mill having a pair of work rolls on upper and lower sides of a material traveling path, two pairs of intermediate rolls on the upper and lower sides, said intermediate rolls contacting said work rolls to impart driving force to said work rolls, and two pairs of backing rolls on the upper and lower sides, said backing rolls contacting and supporting said intermediate rolls, wherein said rolling mill comprises a pair of backing roll chocks on the upper and lower sides, said pair of backing roll chocks supporting two upper backing rolls on the upper side of said two pairs of backing rolls and two lower backing rolls on the lower side of said two pairs of backing rolls and means for moving the backing roll chocks in a housing in an up and down direction, respectively;

a pair of intermediate roll chocks on the upper and lower sides, said pair of intermediate roll chocks supporting two upper intermediate rolls on the upper side of said two pairs of intermediate rolls and two lower intermediate rolls on the lower side of said two pairs of intermediate rolls, respectively;

a pair of work roll chocks on the upper and lower sides, said pair of work roll chocks supporting an upper work roll on the upper side of said pair of work rolls and a lower work roll on the lower side of said pair of work rolls, respectively;

means for driving and axially shifting at least said intermediate rolls of said intermediate rolls and said intermediate roll chocks; and intermediate roll bending means and work roll bending means each for applying bending force to said intermediate rolls and said work rolls; and wherein said intermediate rolls and said backing rolls each are one piece rolls, wherein at least one of said backing roll chocks and said intermediate roll chocks has two second bearings rotatably supporting the corresponding two ones of said backing rolls or intermediate rolls, two through holes provided corresponding to the supporting positions of said corresponding backing rolls or intermediate rolls and two third sleeves rotatably provided inside said through holes and eccentrically arranging said second bearings.

25. A ten roll cluster type rolling mill comprising:

a mill housing, an upper work roll and a lower work roll disposed to roll material passing therebetween in a rolling material travel direction, a pair of upper intermediate rolls spaced from one another in the travel direction supportingly engaged with the upper work roll, said upper intermediate rolls being supported together in a respective upper intermediate roll chocks, a pair of lower intermediate rolls spaced from one another in the travel direction and supportingly engaged with the lower work roll, said lower intermediate rolls being supported together in a respective lower intermediate roll chock, a pair of upper backing rolls spaced from one another in the travel direction and supportingly engaged with respective ones of the upper intermediate rolls, said upper backing rolls being supported together in a respective upper backing roll chock that is supported at the housing to be vertically movable with respect to the housing, a pair of lower backing rolls spaced from one another in the travel direction and supportingly engaged with respective ones of the lower intermediate rolls, said lower backing rolls being supported together in a respective lower backing roll chock that is supported at the housing to be vertically movable with respect to the housing, and means for axially shifting said intermediate roll chocks during rolling operations.

26. According to claim 25, wherein at least one of said backing rolls comprises a first common roll shaft, a plurality of division barrel portions eccentrically passed through by said first common roll shaft and rotatably mounted on said first common roll shaft, a plurality of first bearings provided on the peripheries of said division barrel portions, respectively, a first sleeve rotatably provided on the outer peripheral side of said plurality of division barrel portions through said plurality of first bearings and contacting with the corresponding one or ones of said intermediate rolls.

27. According to claim 25, wherein at least one of said backing rolls has a second roll shaft, and a second sleeve provided on the outer periphery of said second roll shaft and contacting with the corresponding one or ones of said intermediate rolls, said second sleeve having inside a pressurized oil passage and being constructed so that an outer diameter profile of said second sleeve can be adjusted with pressurized oil led thereto.

28. According to claim 27, wherein at least one of said backing roll chocks and said intermediate roll chocks has two second bearings rotatably supporting the corresponding two ones of said backing rolls or intermediate rolls, two through holes provided corresponding to the supporting positions of said corresponding backing rolls or intermediate rolls and two third sleeves rotatably provided inside said through holes and eccentrically arranging said second bearings.

* * * * *